US009482437B2

(12) United States Patent
Kemper

(10) Patent No.: US 9,482,437 B2
(45) Date of Patent: Nov. 1, 2016

(54) FRONT FRAME FOR A COOKING DEVICE

(71) Applicant: Miele & Cie. KG, Guetersloh (DE)

(72) Inventor: Lars Kemper, Oelde (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 14/332,454

(22) Filed: Jul. 16, 2014

(65) Prior Publication Data

US 2015/0022068 A1 Jan. 22, 2015

(30) Foreign Application Priority Data

Jul. 17, 2013 (DE) ..... 10 2013 107 618

(51) Int. Cl.

| | |
|---|---|
| ***E06B 3/50*** | (2006.01) |
| ***F24C 15/18*** | (2006.01) |
| ***F24C 15/02*** | (2006.01) |
| *A47B 53/02* | (2006.01) |

(52) U.S. Cl.

CPC ..... *F24C 15/18* (2013.01); *F24C 15/028* (2013.01); *A47B 53/02* (2013.01)

(58) Field of Classification Search

CPC ..... A47B 53/02; F24C 15/18; F24C 15/028; G07B 3/04

USPC ..... 312/109

See application file for complete search history.

(56) References Cited

U.S. PATENT DOCUMENTS

| | | | | |
|---|---|---|---|---|
| 749,264 | A * | 1/1904 | Cree et al. | 312/109 |
| 1,067,376 | A * | 7/1913 | Rowlette | 312/108 |
| 2,335,279 | A * | 11/1943 | Hobson | F24C 15/08 126/39 B |
| 7,686,179 | B2 * | 3/2010 | Chen | 220/4.27 |
| 2007/0175885 | A1 | 8/2007 | Brower et al. | |
| 2008/0308709 | A1 * | 12/2008 | Tartan et al. | 248/678 |
| 2011/0041831 | A1 | 2/2011 | Dettloff | |
| 2011/0107208 | A1 * | 5/2011 | Michaelraj | 715/702 |
| 2011/0147361 | A1 | 6/2011 | Kemper et al. | |
| 2016/0169529 | A1 * | 6/2016 | Deng | F24C 15/02 126/191 |

FOREIGN PATENT DOCUMENTS

| | | | | |
|---|---|---|---|---|
| DE | 1938232 | U | 5/1966 | |
| DE | 102007005716 | A1 * | 8/2008 | |
| GB | 1331105 | A * | 9/1973 | F24C 15/08 |
| GB | 2346438 | A | 8/2000 | |
| WO | WO 2011128864 | A1 | 10/2011 | |

* cited by examiner

*Primary Examiner* — Daniel J Troy
*Assistant Examiner* — Andres Gallego
(74) *Attorney, Agent, or Firm* — Leydig, Voit & Mayer, Ltd.

(57) ABSTRACT

A front frame for a cooking appliance having at least one first cooking chamber which has a loading opening and a cooking chamber door for closing the loading opening. The front frame includes at least one first front frame unit. The at least one first front frame unit substantially completely frames the loading opening of the first cooking chamber. At an outer edge region of the at least one first front frame unit, a coupling region having at least one coupling device is formed at which an additional front frame unit can be coupled.

6 Claims, 2 Drawing Sheets

FRONT FRAME FOR A COOKING DEVICE

CROSS-REFERENCE TO RELATED APPLICATIONS

This application claims priority from German Patent Application No. DE 10 2013 107 618.1, filed Jul. 17, 2013, which is hereby incorporated by reference herein in its entirety.

FIELD

The present invention relates to a front frame for a cooking appliance having at least one first cooking chamber which has a loading opening and a cooking chamber door for closing the loading opening.

BACKGROUND

Cooking appliances having a front frame which, by means of a frame unit, provides a tidy and uniform appearance when the cooking chamber door is open are known in the art. Besides cooking appliances that have a single cooking chamber, other cooking appliances have become known which, for example, have two adjacent cooking chambers, such as, for example, so-called "double ovens" or cooking appliances which have a cooking chamber that has a thermal heat source and a cooking chamber that has a microwave heat source or a steam heat source. Such appliances require other front frames. However, because of their size, front frames for cooking appliances having two adjacent cooking chambers cannot be economically stamped out in one piece from a metal plate, since the tooling costs are high and the number of units produced is relatively low. In addition, front frames of such a large size are difficult to handle during manufacture, assembly, storage and also during shipping. Moreover, front frames are typically matched to specific models of cooking appliances or combinations of cooking chambers, since the cooking chambers may have different sizes, so that different combinations of cooking chambers require different, specifically tailored double front frames.

SUMMARY

In an embodiment, the present invention provides a front frame for a cooking appliance having at least one first cooking chamber which has a loading opening and a cooking chamber door for closing the loading opening. The front frame includes at least one first front frame unit. The at least one first front frame unit is configured to substantially completely frame the loading opening of the first cooking chamber. At an outer edge region of the at least one first front frame unit, a coupling region having at least one coupling device is formed at which an additional front frame unit can be coupled.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
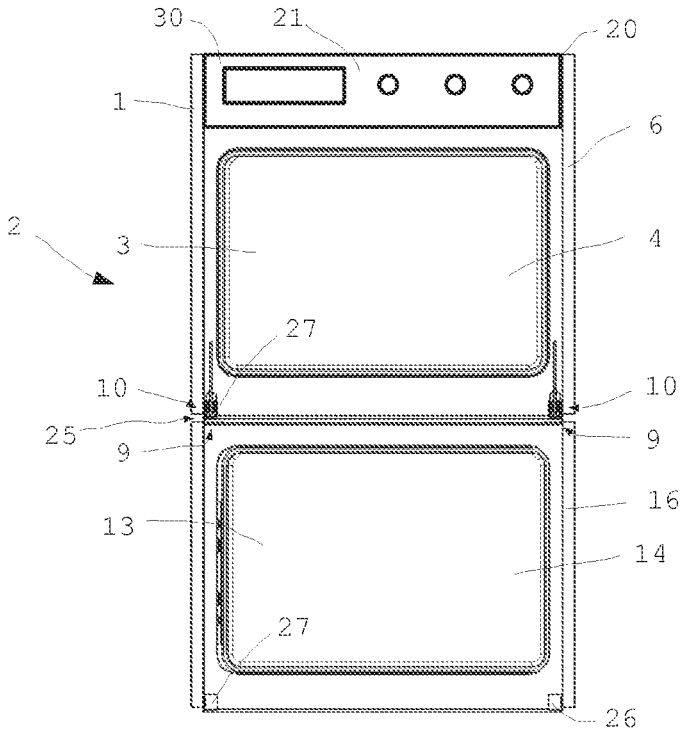
FIG. 1 is a front view of a cooking appliance having a front frame according to the present invention.

In an embodiment, the present invention provides a cooking appliance that may have one or more cooking chambers, a front frame which can give the cooking appliance an appealing appearance, even when the cooking chamber door is open, and which is overall inexpensive to manufacture.

A front frame according to the present invention is intended for use in a cooking appliance having at least one first cooking chamber. The front frame is suitable and adapted for use in a cooking appliance having at least one first cooking chamber which has an associated loading opening and an associated cooking chamber door for closing the loading opening. The front frame according to the present invention includes at least one first front frame unit. The at least one first front frame unit is adapted to substantially completely frame the loading opening of the first cooking chamber. A coupling region having at least one coupling device is formed at an outer edge region of the at least one first front frame unit. If necessary, at least one additional front frame unit can be coupled at the coupling device.

The front frame according to the present invention has many advantages because it allows for flexible use. The first front frame unit can be used for both cooking appliances having a single cooking chamber and cooking appliances having two or more cooking chambers. The present invention reduces the number of models to be produced and stored and for which spare parts need to be kept available. This makes it possible to increase the number of units produced and to thereby reduce the manufacturing expense.

In a preferred embodiment of the front frame according to the present invention, a front frame is adapted for a cooking appliance having a first and at least a second cooking chamber. In particular, the front frame is adapted for a cooking appliance where the loading openings of the cooking chambers are adjacent to each other. Specifically, the loading openings of the cooking chambers may be disposed laterally adjacent to each other or, for example, vertically one above the other during normal use. Other configurations are also possible. In such an embodiment, it is preferred to provide at least one second front frame unit in addition to the first front frame unit. The second front frame unit is then preferably configured to substantially completely frame the second cooking chamber. The second front frame unit is then coupled to the first front frame unit at the coupling region. Such coupling at the coupling region provides a uniform outer surface, creating a uniform appearance.

In all embodiments, at least one cooking chamber may be heated by at least one heat source selected from a group including upper heating elements, lower heating elements, fan oven elements, microwave heat sources, steam heat sources, grill heat sources, and other heating elements. It is also possible, in particular, that two or more heat sources are provided for heating at least one cooking chamber. Similarly, it is possible that each cooking chamber of a cooking appliance may be heatable by one or two or more different heat sources. Moreover, it is possible that two cooking chambers of a cooking appliance may be heated by a common heat source. Thus, for example, one steam heat source may be provided to heat both cooking chambers. It is also possible that one thermal heat source is provided for one, the other or both cooking chambers via a convention or hot air mode. This applies analogously when three or more cooking chambers are provided.

In preferred embodiments, at least one coupling device of at least one front frame unit is concealed by at least one functional component of the cooking appliance when the cooking appliance is in the operational state. When the cooking chamber door is closed, the coupling device is preferably concealed at least by the cooking chamber door itself. When the cooking chamber door is open, the coupling device is preferably concealed by at least one additional functional component of the cooking appliance. Particularly preferably, the coupling region as a whole is at least partially concealed by the functional component. Such embodiments have the important advantage that the coupling device is not visible to the user in the normal condition of use. Such a functional component may, for example, be the door hinge, which conceals the coupling device even when the cooking chamber door is open. Since such a functional component conceals the coupling device or the coupling region, no additional parts, such as covers, are needed to conceal the coupling elements of the coupling device. In addition, an even more uniform overall appearance is produced because no additional components are needed or become visible.

In preferred embodiments, the first and second front frame units are, at least in some portions, identical in configuration. In particular, the first and second front frame units are, in particular, partially and preferably substantially, or even completely, identical in configuration. Such embodiments have the additional advantage that the number of components needed for different models can be further reduced. Front frame units which are identical in configuration can be used for both single and double ovens. In the case of double ovens whose cooking chambers are disposed, for example, one above the other, the one front frame unit can be used for both the upper cooking chamber and the lower cooking chamber. The same is true for the right and left front frame units in the case of cooking chambers which are disposed side-by-side.

In preferred embodiments, at least one front frame unit has at least one receiving means for at least one component to be received. Such a component to be received may, for example, be a display panel or a control panel or a display and control panel. However, user control of the cooking appliance may also be decoupled from the cooking appliance itself and may be performed by remote control. Remote control may be performed, for example, via a network from a computer, a handheld computer or even a microcomputer having telephone features, or also via a touch pad or the like. The receiving means may include a flange or also two or more flanges. In preferred embodiments, two lateral flanges are provided between which, for example, a display and/or control panel may be disposed. It is also possible that the loading opening and, for example, a control panel are jointly framed by one front frame unit, or also both front frame units, with an opening of corresponding size.

In all embodiments, it is preferred that at least one front frame unit have at least one door surround.

In particular, it is also possible that a lateral door surround is provided as well. In such embodiments, the front frame is preferably not configured as an only two-dimensional front panel, but rather is configured to extend also into the depth, for example, in the form of a door frame or the like It is preferred that at least one of the at least one door surround terminate or have a gap in the region of a loading and/or door opening. Thus, for example, a front or door pane of a cooking chamber door covering the front frame unit in the closed position can enter into the gap as the cooking chamber door is opened.

When the cooking chamber door is closed, the gap is virtually invisible and the large-area cooking chamber door provides a uniform front for the cooking appliance. When the cooking chamber door is opened, a portion of the door or door pane enters into the gap during the opening process. In this condition, too, a uniform overall appearance is produced.

However, it is also possible that the cooking chamber door does not cover an outer, in particular lateral, edge region of the front frame unit. In this case, there is no need for such a gap in the front frame unit, since the door pane does not need to enter therein.

Preferably, at least one pass-through opening is provided in the coupling region of at least the first and/or the second front frame unit. Such a pass-through opening in a front frame unit in particular allows for receiving of a functional component of the cooking appliance, and in particular a hinge, which is connected to the body of the cooking appliance.

Preferably, at least one coupling element is provided in the region of the pass-through opening or in the vicinity thereof. If the first and/or second front frame unit has a coupling element in the region of the pass-through opening, then the two front frame units can there be connected to each other, thus giving the two connected units a uniform overall appearance. One coupling element may, for example, be formed as a mounting tab on one front frame unit, whereas the other coupling element may be formed as a through-hole on the other front frame unit. Preferably, the two front frame units may be easily and precisely adjusted relative to each other and connected to each other by means of a screw connection.

Preferably, the coupling device is also disposed in the region of the pass-through opening. The coupling device and/or at least one coupling element of the coupling device in the region of the pass-through opening offers important advantages because the coupling device is accessible from the front thanks to the pass-through opening. To this end, it is preferred that the functional component, and in particular the hinge, be mountable to the body of the cooking appliance only after the at least one frame unit is mounted and, in particular, as late as when the cooking appliance is in its installed position. This allows the installer or costumer to preferably couple the front frame units at the location of installation. This simplifies assembly and reduces the cost associated therewith. Another advantage is that when the cooking appliance is in a state ready for use, the coupling device is not visible because it is concealed by the functional component or the hinge of the cooking chamber door. The front frame is overall easier to clean and provides a visually uniform appearance. In the case of two cooking chambers, such a front frame provides an aesthetic overall appearance because the two cooking chambers are perceived as one combined cooking appliance.

A connecting unit which is used, in particular, to screw the two front frame units together may also be used as a coupling device or coupling element.

In all embodiments, it is preferred that at least one front frame unit be at least partially made of a special steel. In particular, a special steel is used which is resistant to the foods and liquids typically used in kitchens in order to ensure a visually appealing surface over a long period of time.

In all embodiments, the door surround may be manufactured as a single piece or as an assembly of multiple parts.

A front frame according to the present invention is intended in particular for a double oven and includes at least two front frame units. In such a front frame according to the present invention, the two front frame units are connected to each other in such a way as to produce a uniform overall appearance.

Preferably, the present invention is also directed to a cooking appliance including at least one cooking chamber and a front frame having at least one front frame unit, such as has been described hereinabove.

Further advantages and features of the present invention will become apparent from the exemplary embodiment that is described below with reference to the accompanying figures.

In FIG. 1, cooking appliance 2 is shown in a schematic front view with the cooking chamber doors removed. Cooking appliance 2 includes two cooking chambers 3 and 13 which here are disposed one above the other and are accessible via respective loading openings 4 and 14.

A front frame 1, here including two front frame units 6 and 16, is provided to surround cooking chambers 3, 13 in a uniform manner. In the exemplary embodiment shown, front frame unit 6 is provided for upper cooking chamber 3, whereas front frame unit 16 is provided for the loading opening 14 of lower cooking chamber 13.

The two front frame units 6 and 16 of front frame 1 together form a uniform surround for the two cooking chambers 4 and 14, so that a visually appealing overall appearance is produced.

A receiving means 20 for receiving a component 21 is provided in the upper region of front frame 1. The component 21 received is here a control and display panel 30 which may have one or more displays or one or more controls in the form of, for example, control knobs. It is also possible for such a control and display panel to be provided separate from front frame 1.

In the lower region of front frame units 6 and 16, pass-through openings 26 are provided in the region of the respective lateral ends. Pass-through openings 26 serve for receiving and mounting hinges 12 and may therefore also be referred to as hinge receptacles 27.

In the region of each of pass-through openings 26, a coupling region 9 is provided in which a coupling device 10 is provided to there couple upper front frame unit 6 to lower front frame unit 16 and fixedly connect the two units together.

At the two lateral ends, there may be provided gaps 25 into which cooking chamber door 5, respectively 15, as a whole or the pane thereof enters as the cooking chamber door is opened. Such an embodiment offers the advantage that not only the loading openings 4, 14 of the respective cooking chambers 3, 14, but also the front frame units 6 and 16 are covered when cooking chamber doors 5, 15 are in the closed position. Cooking chamber doors 5, respectively 15, are then visible from the front (see FIG. 4). Front frame units 6 and 16 do not become visible until in the open position. Together, they provide a uniform surround for cooking chambers 3 and 13.

Figure 2A:
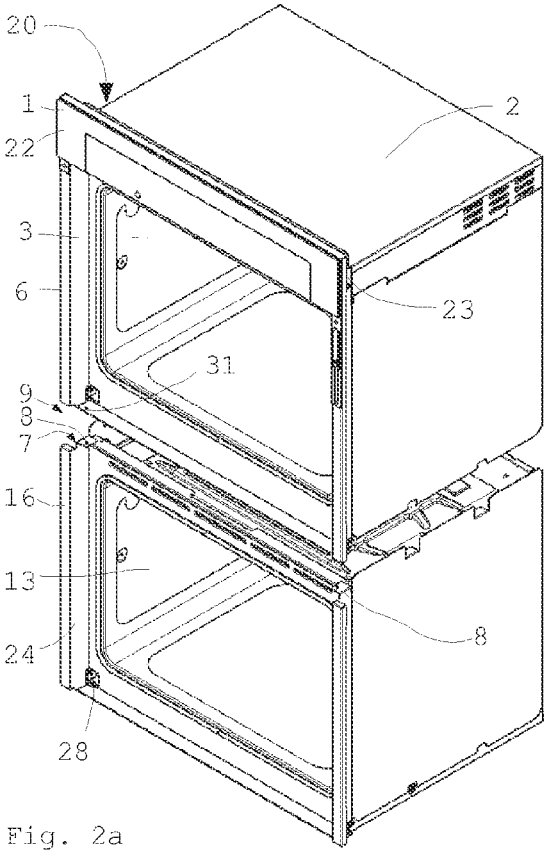
FIG. 2*a* is a perspective view of the cooking appliance of FIG. 1 during assembly.

In FIG. 2*a*, cooking appliance 2 is shown in a schematic perspective view with the upper cooking chamber 3 lifted off the lower cooking chamber 13. The coupling elements 8 of the here lower front frame unit 16, which are disposed in coupling region 9 and form part of coupling device 10, are visible in this exploded view. Coupling elements 8 are here in the form of angled tabs and each have a screw hole 31. The coupling elements 8 in the form of retaining tabs 33 are folded laterally inwardly from the lateral frame members 37 of front frame unit 16. Consequently, the two retaining tabs 33 are folded toward one another. A retaining pin or dowel 32 is formed on or attached to each retaining tab 33 in order to connect front frame units 6 and 16 to each other in a defined position. In other embodiments, screws may be used to join front frame units 6 and 16.

The two coupling devices 10 are disposed in the outer edge regions 7 and 17 of front frame unit 16.

Figure 3:
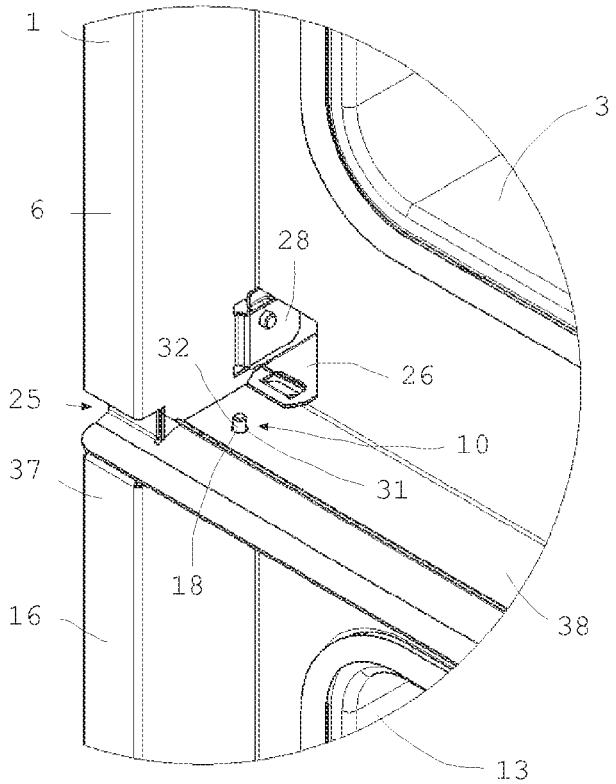
FIG. 3 is an enlarged view showing the connection region of the front frame units of the front frame of FIG. 1.

As can be seen in FIG. 3, coupling elements 18 of coupling device 10 are correspondingly provided in coupling region 9 on the here upper front frame unit 6.

As can be seen in FIG. 2, receiving means 20 is surrounded by two flanges 22, 23 which form part of front frame unit 6. Flanges 22, 23 are formed at the lateral frame members.

FIG. 2*a* shows a condition prior to connection of the two cooking appliance sections.

Figure 2B:
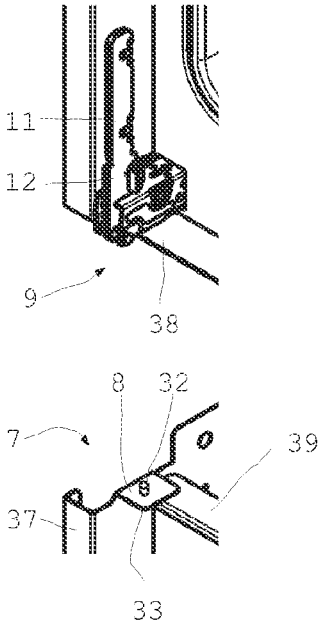
FIG. 2*b* is an enlarged view showing a detail of the cooking appliance of FIG. 1 during assembly.

FIG. 2*b* schematically shows an enlarged detail from FIG. 2*a*, where a functional component 11 and here a hinge 12 for attachment of cooking chamber door 5 are mounted in coupling region 9. Hinge 12 is typically not mounted until both front frame units 6 and 16 have been fixedly connected to each other. Hinge 12 has the agreeable side effect of at least substantially, and in particular completely, concealing the coupling device 10, and thus the coupling element 8 in the form of the folded-down retaining tab 33, as well as the hole 31 in lower frame member 38, so that after functional component 11 is installed, the connection points of the two front frame units 6 and 16 can no longer be seen.

Retaining tabs 33, which are folded down inwardly toward the center of the cooking appliance, here by 90°, also allow for different depths of lower frame member 38 of front frame unit 6 and upper frame member 39 of front frame unit 16. Such an offset in depth has advantages in terms of construction and visual appearance.

A functional component 11 and here a hinge 12 are disposed in the region of pass-through opening 26 to hold cooking chamber door 5 or 15, respectively.

At pass-through opening 26, mounting devices 28 may be provided, for example in the form of rearwardly projecting mounting tabs, for connection of the front frame to the body of cooking appliance 2.

FIG. 3 shows, in an enlarged view, a detail of left coupling region 9 where upper front frame unit 6 is connected to lower front frame unit 16. A coupling element 18 serves to couple the two front frame units 6 and 16. Coupling element 18 is in the form of a dowel 32 extending through an adapted opening or hole 31 in the lower frame member 38 of the frame for upper cooking chamber 3.

Front frame 1 here forms a door surround 24, so that front frame 1 is overall shaped three-dimensionally. At door surround 24, gaps 25 are provided into which cooking chamber door 5, respectively 15, enters when in the open position.

Figure 4:
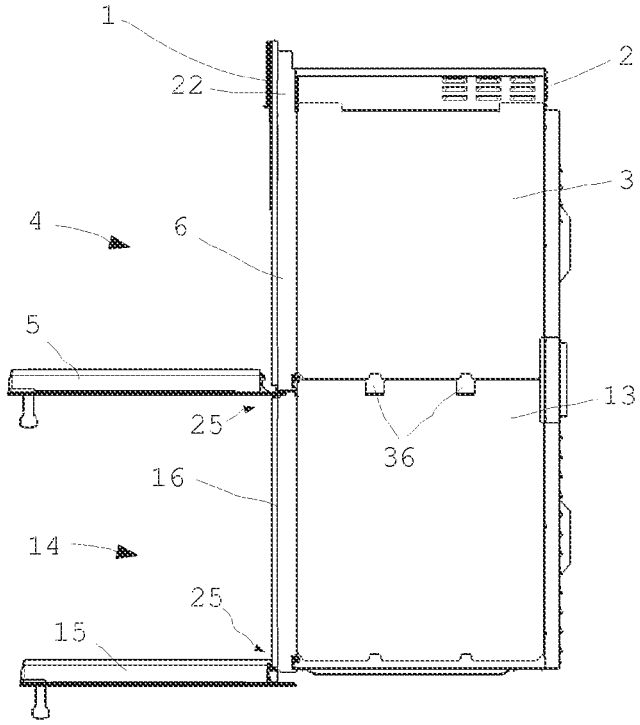
FIG. 4 is a schematic side view of the cooking appliance of FIG. 1 with the cooking chamber doors open.

FIG. 4 shows a highly schematic side view of the cooking appliance 2 according to the present invention with a front frame 1 according to the present invention and with cooking chamber doors 5 and 15 in the open position. Front frame units 6 and 16 each have a gap 25 in the lower region, into which gap the lower end of the respective cooking chamber door 5 or 15 enters as the door is opened.

A receiving means 20 for receiving, for example, a control and display panel 30 may be provided on front frame 1.

Altogether, the present invention provides an advantageous front frame 1 and an advantageous cooking appliance 2, where the front frame 1 can be designed for a wide variety of applications and can be made from fewer parts than in the prior art. Depending on whether a receiving means 20 is to be provided, there are basically two possible types of front frame units. This depends on whether a cooking appliance is intended to have two cooking chambers or only one cooking chamber. First front frame unit 6 and second front frame unit 16 may be of identical configuration. The specific configuration is independent of whether the respective front frame unit is intended for a cooking appliance with one cooking chamber or one with two cooking chambers. In principle, it is of course also possible to provide a front frame according to the present invention having three or four or more front frame units for three or four or more cooking chambers.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 front frame
2 cooking appliance
3 cooking chamber
4 loading opening
5 cooking chamber door
6 front frame unit
7 edge region
8 coupling element, folded-down retaining tab
9 coupling region
10 coupling device
11 functional component
12 hinge
13 cooking chamber
14 loading opening
15 cooking chamber door
16 front frame unit
17 edge region
18 coupling element
20 receiving means
21 component
22 flange
23 flange
24 door surround
25 gap
26 pass-through opening
27 hinge receptacle
28 mounting device
30 control and display panel
31 hole, screw hole
32 dowel
33 retaining tab
36 connecting unit
37 lateral frame member
38 lower frame member
39 upper frame member

What is claimed is:

1. A front frame for a cooking appliance having a first cooking chamber and a second cooking chamber, each of which has a loading opening and a cooking chamber door for closing the loading opening connected to the cooking chamber by two hinges, the loading openings of the first and second cooking chambers being adjacent to each other, said front frame comprising:

a first front frame unit configured to substantially completely frame the loading opening of the first cooking chamber, the first front frame unit including two pass-through openings in a lower region of the first front frame unit, a coupling region provided in a region of each pass-through opening, a coupling device in each coupling region, and mounting tabs projecting rearwardly into each pass-through opening, respectively, the mounting tabs being configured to connect the front frame to the first cooking chamber, and wherein the two pass-through openings are, respectively, configured to receive the two hinges of the cooking chamber door of the first cooking chamber; and a second front frame unit configured to substantially completely frame the loading opening of the second cooking chamber and which is coupled to the first front frame unit at the coupling regions by the coupling devices, wherein, in an operational state of the cooking appliance, the coupling devices and the mounting tabs are adapted to be concealed by the two hinges of the cooking chamber door of the first cooking chamber.

2. The front frame as recited in claim 1, wherein the first and the second front frame units are, at least in some portions, identical in configuration.

3. The front frame as recited in claim 1, wherein at least one of the first front frame unit or the second front frame unit has a receiving mechanism for a component to be received.

4. The front frame as recited in claim 1, wherein at least one of the first front frame unit or the second front frame unit forms a door surround.

5. The front frame as recited in claim 1, wherein at least one of the first front frame unit or the second front frame unit is at least partially made of steel.

6. A cooking appliance comprising:

a first cooking chamber and a second cooking chamber, each of which includes a loading opening and a cooking chamber door for closing the loading opening connected to the cooking chamber by two hinges, the loading openings of the first and second cooking chambers being adjacent to each other;

a first front frame comprising:

a first front frame unit configured to substantially completely frame the loading opening of the first cooking chamber, the first front frame unit including two pass-through openings in a lower region of the first front frame unit, a coupling region provided in a region of each pass-through opening, a coupling device in each coupling region, and mounting tabs projecting rearwardly into each pass-through opening, respectively, the mounting tabs being configured to connect the first front frame to the first cooking chamber, and wherein each of the two hinges of the cooking chamber door of the first cooking chamber is received within the two pass-through openings, respectively; and a second front frame unit configured to substantially completely frame the loading opening of the second cooking chamber and which is coupled to the first front frame unit at the coupling regions by the coupling devices, wherein, in an operational state of the cooking appliance, the coupling devices and the mounting tabs are concealed by the two hinges of the cooking chamber door of the first cooking chamber.

* * * * *